US005359823A

United States Patent [19]

Kidaloski et al.

[11] Patent Number: 5,359,823

[45] Date of Patent: Nov. 1, 1994

[54] GAS LANE BARRIERS BETWEEN MODULES OF HEAT RECOVERY STEAM GENERATORS

[75] Inventors: Raymond G. Kidaloski, Canal Fulton; Roger A. Detzel, Norton, both of Ohio

[73] Assignee: The Babcock & Wilcox Company, New Orleans, La.

[21] Appl. No.: 42,328

[22] Filed: Apr. 2, 1993

[51] Int. Cl.[5] ..... E04B 2/00; F22B 37/00

[52] U.S. Cl. ..... 52/506.01; 52/192; 52/648.1; 52/712; 49/463

[58] Field of Search ..... 52/233.3, 712, 80.2, 52/509, 511, 512, 202, 506.01, 506 R, 242, 192, 196, 648.1; 248/68.1; 49/463, 465

[56] References Cited

U.S. PATENT DOCUMENTS

| | | | |
|---|---|---|---|
| 1,009,809 | 11/1911 | Vernier | 52/192 |
| 2,748,904 | 6/1956 | Arndt | 52/648.1 |
| 2,796,156 | 6/1957 | Harberts | 52/648.1 |
| 3,340,650 | 9/1967 | Sackett, Sr. | 49/463 |
| 4,023,323 | 5/1977 | Fortin | 52/712 |
| 4,069,636 | 1/1978 | Kessler | 52/712 |
| 4,246,736 | 1/1981 | Kovar et al. | 52/712 |
| 4,970,836 | 11/1990 | Brown | 49/465 |
| 4,970,842 | 11/1990 | Kappeler et al. | 52/712 |
| 5,077,945 | 1/1992 | Koeniger | 49/463 |
| 5,123,205 | 6/1992 | Folkerts | 49/465 |

*Primary Examiner*—Carl D. Friedman
*Assistant Examiner*—Wynn E. Wood
*Attorney, Agent, or Firm*—Robert J. Edwards; Eric Marich

[57] ABSTRACT

A barrier for blocking a passage between adjacent modules of a heat recovery steam generator comprises at least one plate for extending between the modules. At least one bracket is mounted to the plate for engagement with each structure. The bracket has one end engageable with one module and an opposite end engageable with the other module for securing the plate between the modules such that the passage is blocked.

11 Claims, 4 Drawing Sheets

GAS LANE BARRIERS BETWEEN MODULES OF HEAT RECOVERY STEAM GENERATORS

FIELD AND BACKGROUND OF THE INVENTION

The present invention relates in general to heat recovery steam generators and in particular to a new and useful barrier for blocking a gas lane between modules of a steam generator.

Typically, in the steam generator field, heat recovery steam generators comprise a casing or box-type structure having vertically oriented finned tube pressure parts which form the heat exchanger. High temperature turbine exhaust gas is passed through the casing and over the finned tubes in order to recover heat from the gas.

One popular configuration for a heat recovery steam generator comprises a modular design which utilizes a pre-fabricated and pre-assembled heating surface arrangement. The heat exchangers are manufactured in modules and are arranged side-by-side within a casing. Each module has a frame for handling and field expedient purposes. However, when the modules are positioned adjacent each other in a casing, gas lanes or passages are formed between the modules due to the steel frames of each module. In an effort to maintain the efficiency of the boiler, the gas lanes must be blocked and the gas forced through the heating surface arrangement, which normally comprises spiral finned tubes.

The current solution to the gas lane problem is to employ baffles, made of a light gage sheet metal, that are welded either to the fins of the heating surface or to the frame of each module. It is very common for the gas lane baffles to be welded directly to the spiral fin tubes because of the inaccessibility of the steel frames of the modules. This solution to the gas lane problem has proved to be very costly for field installation and is not very reliable.

SUMMARY OF THE INVENTION

The present invention comprises a gas barrier for heat recovery steam generators of the modular-type that are field expedient, easy to install, durable and reliable.

The present invention comprises a barrier for blocking a passage between adjacent modules having at least one plate for extending between the modules. At least one bracket is mounted to each plate for engagement with each module. The bracket has one end engageable with one module and the opposite end engageable with the other module for securing the plate between the structure such that the passage is blocked.

It is an object of the present invention to provide a gas barrier which eliminates welding to the finned tubes of the heat exchangers.

It is another object of the present invention to provide a barrier for blocking a gas passage which is easy to install.

It is another object of the present invention to provide a gas barrier which is easy to handle and is field expedient.

It is another object of the present invention to provide a barrier for blocking a passage which does not restrict vertical differential thermal growth between the pressure parts and the barrier.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
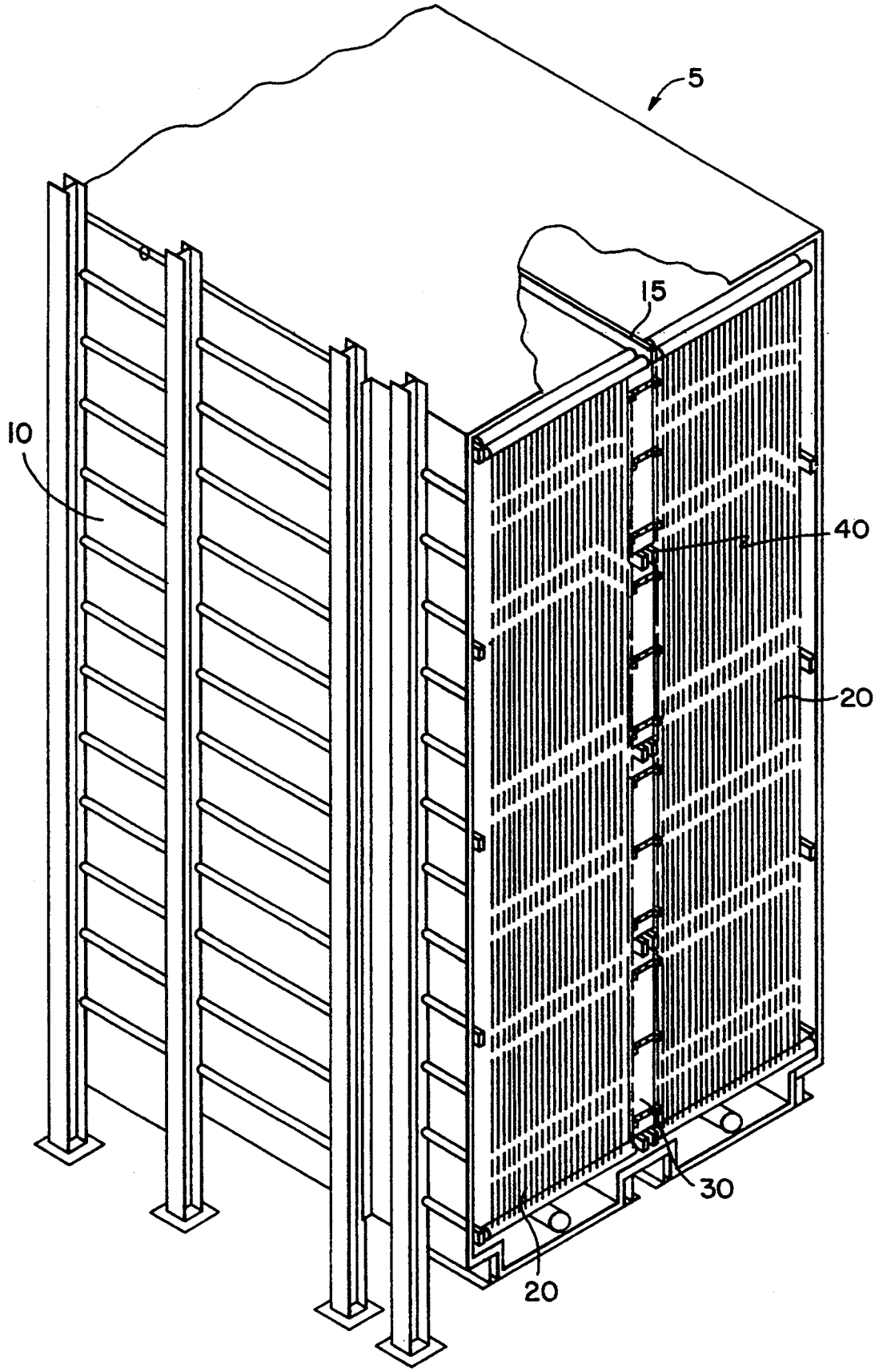
FIG. 1 is a perspective view of a steam generator using a gas barrier according to the present invention.
Figure 4:
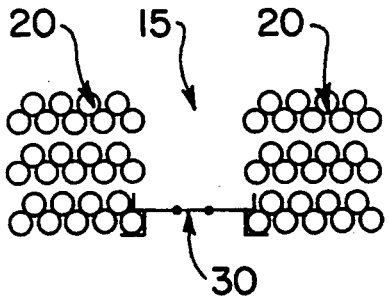
FIG. 4 is a view of FIG. 3 taken along line 4—4.
Figure 2:
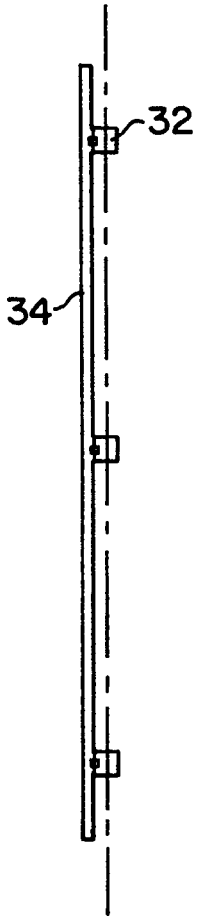
FIG. 2 is a side view of the gas barrier of FIG. 1.
Figure 3:
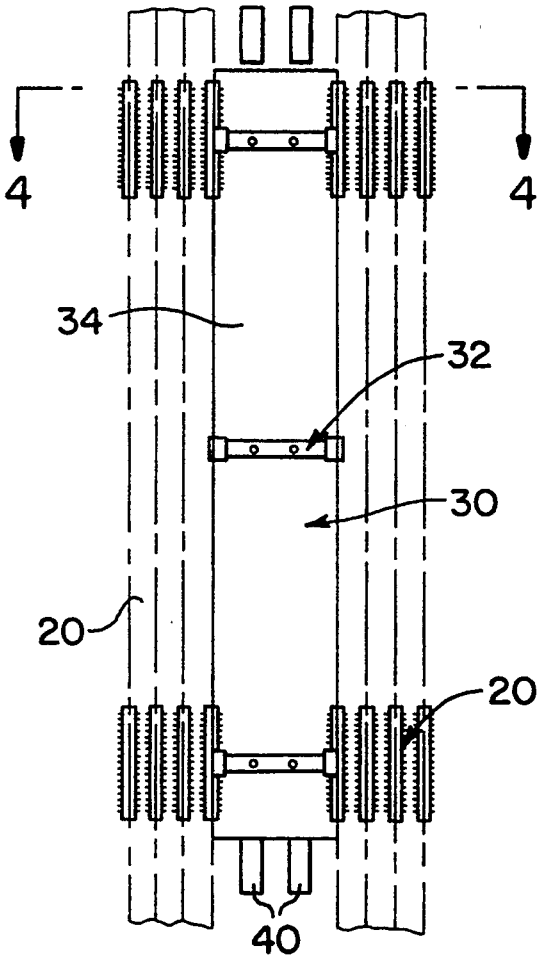
FIG. 3 is a front view of the gas barrier of FIG. 1.

According to the present invention, FIG. 1 illustrates a heat recovery steam generator, generally designated 5, having a box-type enclosure or casing 10 for holding heat exchanger modules 20, which are normally a heating surface comprising spiral finned tubes.

Each heat exchanger module 20 has frames or struts 40 for handling purposes. Thus, when the modules 20 are set adjacent each other, a gas lane or passage 15 is left between the modules 20. In order to increase the efficiency of the heat recovery steam generator 5, a plurality of gas barriers 30 are used to block gas lane 15. As illustrated in FIG. 1, the gas barriers 30 can be arranged in sequence between the modules 20 for blocking the gas passage 15. By using a plurality of the gas barriers 30, portability and field expediency is facilitated.

Figure 5:
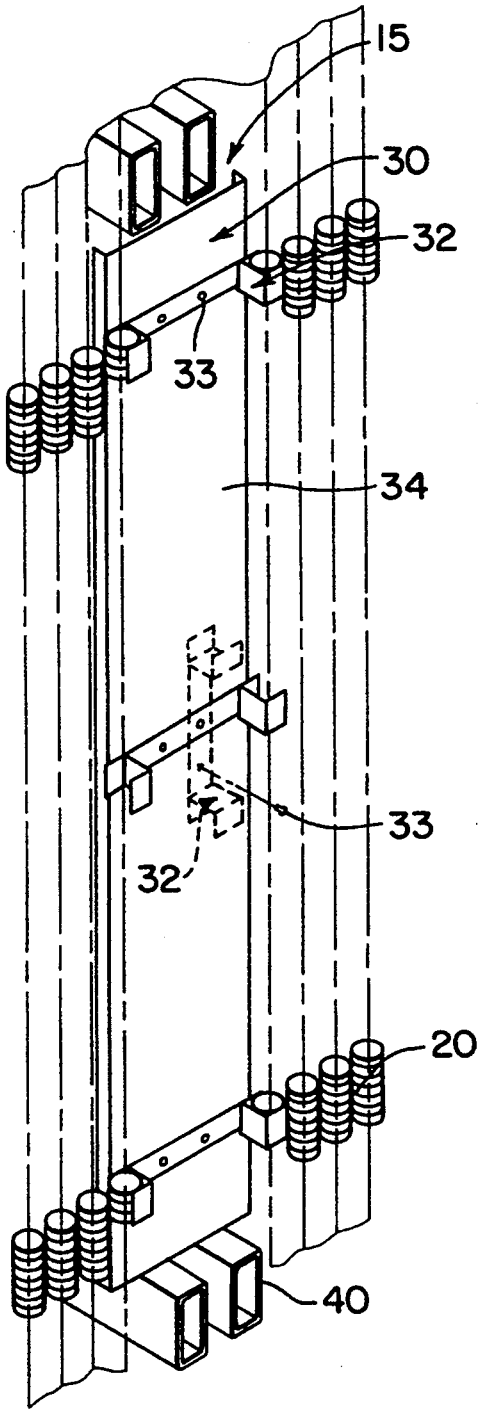
FIG. 5 is a perspective view of a section of FIG. 1.

FIG. 5 illustrates a gas barrier 30 having a plurality of brackets 32 mounted to a plate 34. The plate 34 is preferably a plate having two sides and a bottom in a trough-shaped configuration. The brackets 32 have U-shaped ends which are engageable with the spiral fin tubes of the modules 20. Because the brackets 32 have U-shaped ends which grasp the finned tubes at several positions along the gas barrier 30, they alleviate the need for welding the gas barrier 30 and accommodate differential pressure loading across the plate 34 during operation of the unit 5.

Preferably, the gas barrier 30 is made of a light gage sheet metal formed in the shape of a trough 34 and having three brackets 32 horizontally arranged on the trough 34. The bracket 32 are mounted to the plate 34 by bolts 33 which can be easily removed. The bracket 32 can be rotated into a vertical position, i.e. at least 90°, by removing one of the bolts 33 for accommodating the positioning of the barrier 30 in the gas passage 15. Once the gas barrier 30 is positioned in its proper position, the brackets 32 are rotated back to a horizontal position such that each end grasps a spiral fin tube 20 and the bolt 33 is reinserted for securing the bracket 32 to the plate 34. The bolt 33 is then tack-welded in place for completing the installation of the barrier 30 in the gas passage 15.

Figure 6:
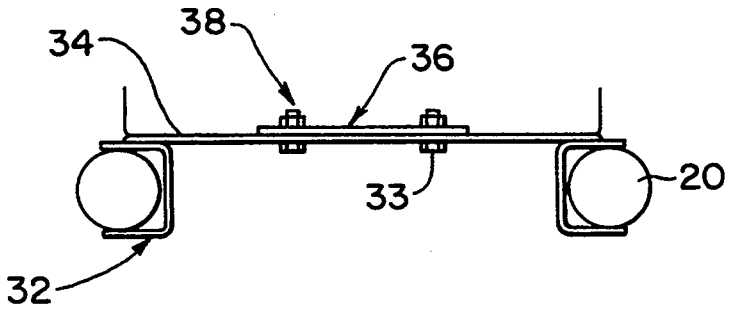
FIG. 6 is top view of the gas barrier of FIG. 1.
Figure 8:
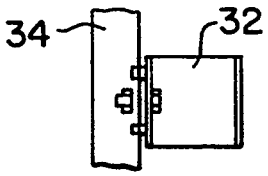
FIG. 8 is a side view of FIG. 6.
Figure 7:
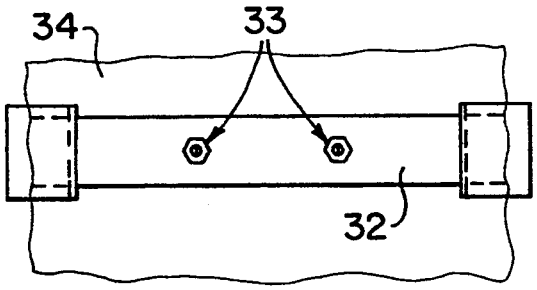
FIG. 7 is a front view of FIG. 6.

FIG. 6 shows a reinforcement 36 which is mounted to the plate 34 on a side opposite of the bracket 32. The reinforcement 36 provides support to the plate 34 and is mounted by fasteners 38. Preferably, the reinforcement 36 is a flat bar. The flat bar 36 and the fasteners 38 facilitate the bolting of the bracket 32 to the plate 34 by the bolts 33.

While a specific embodiment of the invention has been shown and described in detail to illustrate the application of the principles of the invention, it will be understood that the invention may be embodied otherwise without departing from such principles.

We claim:

1. A barrier for blocking a passage between adjacent structures, the barrier comprising:

at least one plate for extending between the structures; and at least one bracket mounted to the plate for engaging each structure, each end of the bracket having one U-shaped end which is engageable with one structure and an opposite U-shaped end which is engageable with the other structure, the bracket for securing the plate between the structures such that the passage is blocked, the barrier including a reinforcement mounted to the plate on a side opposite of the bracket and at least one fastener for mounting the reinforcement to the plate.

2. The barrier according to claim 1, wherein the plate comprises a bottom and two sides defining a trough.

3. A method for blocking a gas passage between two adjacent heat exchanger structures having finned tubes, the method comprising:

providing at least one barrier including a plate and at least one bracket having U-shaped ends and which is movably and rotatably mounted to the plate;

positioning the at least one barrier in the passage between the adjacent structures such that the plate extends between the structures; and engaging one U-shaped end of the bracket to one of the structures and the opposite U-shaped end of the bracket to the other structure for securing the plate between the structures such that the passage is blocked by rotating the bracket on the plate from a vertical position to a horizontal position to engage the U-shaped ends thereof with the finned tubes of the adjacent heat exchanger structures.

4. A barrier for blocking a passage between adjacent structures, the barrier comprising:

at least one plate for extending between the structures; and at least one bracket mounted to the plate for engagement with each structure, each end of the bracket having one U-shaped end which is engageable with one structure and an opposite U-shaped end which is engageable with the other structure for securing the plate between the structures such that the passage is blocked, the barrier including at least one bolt for securing the bracket to the plate, the bracket being movable and rotatable about the bolt at least 90°.

5. The barrier according to claim 4, wherein the plate comprises a bottom and two sides defining a trough.

6. In combination, a heat recovery steam generator having adjacent heat exchanger modules of tubes defining a gas passage therebetween, and a gas barrier for blocking the gas passage, the gas barrier comprising:

at least one plate extending between the adjacent modules;

at least one bracket mounted to the plate, each end of the bracket having one U-shaped end which is engaged with one of the modules and an opposite U-shaped end which is engaged with the other module to secure the plate between the modules and block the gas passage; and a reinforcement mounted by at least one fastener to the plate on a side opposite the bracket.

7. The combination of claim 6, wherein the plate comprises a bottom and two sides defining a trough.

8. The combination of claim 6, wherein the tubes are finned and the U-shaped ends of the bracket engage finned tubes.

9. In combination, a heat recovery steam generator having adjacent heat exchanger modules of tubes defining a gas passage therebetween, and a gas barrier for blocking the gas passage, the gas barrier comprising:

at least one plate extending between the adjacent modules;

at least one movable bracket rotatably mounted to the plate, each end of the bracket having one U-shaped end which is engaged with one of the modules and an opposite U-shaped end which is engaged with the other module to secure the plate between the modules and block the gas passage; and at least one bolt for securing the bracket to the plate so that the bracket is movable and rotatable about the bolt at least 90° to engage the U-shaped ends thereof with the modules.

10. The combination of claim 9, wherein the plate comprises a bottom and two sides defining a trough.

11. The combination of claim 9, wherein the tubes are finned and the U-shaped ends of the bracket engage the finned tubes when the bracket is rotated about said bolt.

* * * * *